US007572118B2

(12) United States Patent
Frolik

(10) Patent No.: US 7,572,118 B2
(45) Date of Patent: Aug. 11, 2009

(54) ROTARY MACHINE WITH ORBITING TWIN BLADES, ESPECIALLY FOR EXPANSION DRIVE UNITS AND COMPRESSORS

(76) Inventor: Jiri Frolik, Makovskeho 1340, Praha 6 (CZ) 163 00

( * ) Notice: Subject to any disclaimer, the term of this patent is extended or adjusted under 35 U.S.C. 154(b) by 11 days.

(21) Appl. No.: 11/393,518

(22) Filed: Mar. 29, 2006

(65) Prior Publication Data

US 2006/0222544 A1 Oct. 5, 2006

(51) Int. Cl.
*F03C 2/00* (2006.01)
*F04C 18/00* (2006.01)

(52) U.S. Cl. ..... 418/254; 418/241; 418/150

(58) Field of Classification Search ..... 418/241, 418/253–255, 150, 206.1, 171, 166, 54, 91, 418/92

See application file for complete search history.

(56) References Cited

U.S. PATENT DOCUMENTS

| | | | | | |
|---|---|---|---|---|---|
| 1,940,384 | A | * | 12/1933 | Zoller | 418/254 |
| 1,994,245 | A | * | 3/1935 | Gette, Jr. | 418/255 |
| 2,070,662 | A | * | 2/1937 | Johnson | 418/91 |
| 3,001,482 | A | * | 9/1961 | Osborn | 418/85 |
| 3,294,454 | A | * | 12/1966 | Foerster et al | 418/245 |
| 4,449,899 | A | * | 5/1984 | Smolinski | 418/255 |
| 5,316,456 | A | * | 5/1994 | Eckhardt | 418/255 |
| 6,368,089 | B1 | * | 4/2002 | Frolik | 418/92 |

FOREIGN PATENT DOCUMENTS

| | | | |
|---|---|---|---|
| DE | 433963 PS | | 9/1925 |
| DE | 433963 | * | 9/1926 |
| FR | 826534 | * | 4/1938 |
| FR | 829970 | * | 7/1938 |
| FR | 1091637 | * | 4/1955 |
| FR | 1091637 | | 11/1955 |
| IT | 920009 | | 2/1994 |
| JP | 56-44489 | | 4/1981 |
| JP | 56-044489 A | * | 4/1981 |
| WO | WO 92/13176 | | 8/1992 |

* cited by examiner

*Primary Examiner*—Theresa Trieu

(57) ABSTRACT

A rotary machine with orbiting twin blades, especially for expansion drive units and compressors, includes a stator housing bounding an internal chamber, a rotor part received in the chamber for rotation and including at least two entraining rings axially spaced from one another and at least four entraining bars interconnecting the entraining rings and defining respective slots between themselves. A carrier shaft is mounted in the internal chamber for rotation and carries for joint rotation therewith at least two pairs of eccentric members. At least two twin blades are each supported on one of the pairs of eccentric members for relative turning therebetween and each includes two blade portions passing through oppositely located associated ones of the slots into close proximity of the inner peripheral surface of the stator housing. A transmission is provided that transmits torque between the rotor part and the carrier shaft in a permanent 1:2 transmission, causing the carrier shaft to rotate in the same direction as but at double the speed of the rotor part and causing the eccentric members mounted thereon to force the twin blades to follow the inner surface of the stator housing still at the aforementioned close proximity thereof.

5 Claims, 14 Drawing Sheets

ROTARY MACHINE WITH ORBITING TWIN BLADES, ESPECIALLY FOR EXPANSION DRIVE UNITS AND COMPRESSORS

BACKGROUND OF THE INVENTION

1. Field of the Invention

The invention relates to a rotary machine with orbiting twin blades, especially for expansion drive units and compressors, which can also be utilized for the field of pumping technology and other work machinery.

2. Description of Related Art

From the U.S. Pat. No. 1,940,384 to Arnold Zöller, there is known a rotary compressor that operates with orbiting twin blades, and more particularly with planar sliders. These planar sliders are forced to move, during rotation, in guiding grooves of an eccentrically supported rotor, and are guided by friction blocks secured therein. As a consequence of the mutual connection of the oppositely located sliders into a single twin blade, there is avoided an increase of the centrifugal forces acting on the blade and, as a result, an increase in the friction work between the blade and the orbit-determining surface of the stator. The filling efficiency of the compressor described there is very high and amounts to 75 to 95%. However, the mechanical efficiency is low as a result of the friction work, ranging between 35 and 65%. This compressor, when operated as a blower, is suited for operation at high rotary speeds, and the filling curve exhibits a linear behavior up to 6000 r.p.m. This compressor was previously used, as the case may be, in the function of a blower, for turbocharging the motors of racing cars.

A significant disadvantage of this type of a compressor is the considerable friction work that is generated in the course of rotation during the rapid forced movement of the blades on the eccentric drum and on the stator wall, which results in a rapid wear of its components.

A multitude of other technical approaches has subsequently concerned itself with the solution of these tribological problems of the aforementioned machine by presenting various alternative constructions that make it possible to accomplish the forced movement of the twin blades situated in the internal space of the rotor, with the aim of reducing the friction work and achieving circular orbiting trajectory of the twin blades.

So, for instance, in the patent documents of JP 56-44489, the twin blades are guided in lateral grooves, as a result of which, however, centrifugal forces increase with increasing rotary speeds and, simultaneously, increase the frictional work. In this solution, moreover, the implementation of only one twin blade is optimized, similarly to another known solution according to the Austrian patent document AT 920009.

In further documents U.S. Pat. No. 3,001,482, DE-PS 433,963 and U.S. Pat. No. 3,294,454, the blades are again guided in lateral grooves; that brings about high frictional resistance during rotation. In the U.S. Pat. No. 2,070,662, the movement of the freely inserted blades is forced by an eccentrically supported rotor entraining member.

The solution in accordance with the patent document FR-A 1091637 is characterized by blades that are pressed against the orbit-determining surface, which again results at higher rotary speeds in an increased friction work.

BRIEF SUMMARY OF THE INVENTION

An important object of the invention is to avoid the aforementioned drawbacks of the preceding solutions, which reside primarily in the creation of undesirable frictional forces at the contact locations between the end portions of the blades and the orbit-determining surface of the stator.

Another object of the present invention is to provide a kind of a rotary support for the twin blades that would be structurally simple.

Still another object of the invention is to construct the above support in such a manner that it would totally eliminate the frictional work between the end portions and the orbit-determining surface of the stator.

Yet another object of the invention is so to design the above support that it would reduce the frictional work between the twin blades and the rotor to a minimum value even at high rotational speeds.

Last but not least, it is an object of the present invention to provide the possibility of incorporation of a significant number of twin blades into the novel structural solution of the rotary machine with orbiting twin blades.

In keeping with these objects and others which will become apparent hereafter, one feature of the present invention resides in a rotary machine with orbiting twin blades, especially for expansion drive units and compressors. This machine includes a stator housing having an inner peripheral surface circumferentially delimiting an enclosed internal chamber extending along a stator axis; a rotor part received in the stator housing for rotation about a rotor axis parallel to and radially offset from the stator axis and including at least two entraining rings axially spaced from one another and at least four entraining bars extending substantially parallel to the rotor axis at a radial distance therefrom, interconnecting the entraining rings, and defining respective slots between themselves; and means for mounting the rotor part for rotation in the internal chamber about the rotor axis. According to the invention, there is further provided a carrier shaft mounted in the internal chamber for rotation about a carrier shaft axis parallel to the rotor axis and extending over the entire axial length of the stator housing; at least two pairs of eccentric members provided on the carrier shaft for joint rotation therewith and centered on respective axes that are transversely offset from the carrier shaft axis in different radial directions; at least two twin blades each supported on one of the pairs of eccentric members for relative turning therebetween and including two blade portions passing through oppositely located associated ones of the slots of the rotor part into close proximity of the inner peripheral surface of the stator housing. Furthermore, there is provided means for transmitting torque between the rotor part and the carrier shaft in a permanent 1:2 transmission ratio such that the carrier shaft with the eccentric members turns in the same direction as but at twice the speed of the rotor part when the rotary machine is in operation such that the eccentric members force the twin blades to conduct movements relative to the rotor part that cause such blades to follow the inner peripheral surface of the stator housing at the aforementioned close proximity therefrom.

An important advantage of the implementation of the rotary machine according to the invention may be seen in the effective elimination of frictional forces which, in the previous devices, come into being at the contact regions of the freely supported blades with the contact stator surface delimiting the working space where, due to the influence of centrifugal forces, there is encountered, especially at high rotational speeds of the rotor, considerable frictional work and, in extreme cases, even catastrophic failure of the machine.

Another advantage is the stable mounting of the individual twin blades on the carrier shaft in accordance with the invention described here, which ensures a constant distance of the end portion of the twin blade from the internal working surface of the stator housing in any working regimen, and which makes it possible to utilize the machine in the region of high rotational speeds simultaneously with an increase in its longevity.

A significant further advantage of this machine is a continuous flow of the working medium in one and the same direction, which renders possible the ganging of several such machines in series for the achievement of multiple expansion or multiple compression of the working medium.

According to another advantageous aspect of the present invention, the stator housing includes an assembly of plate-shaped modules individually connected to one another, at least some adjacent ones of which have internal bores that together constitute the internal chamber of the stator housing. This feature provides for easy manufacture and assembly of the rotary machine.

It is particularly advantageous when the transmission means includes a pinion with external teeth on one of the rings, a carrier shaft gear wheel mounted on the carrier shaft for joint rotation therewith, a countershaft supported on the stator housing and centered on a countershaft axis, a first countershaft gear wheel supported on the countershaft and having external teeth that are in permanent meshing relationship with the external teeth of the pinion, and a second countershaft gear wheel supported on the countershaft, connected with the first countershaft gear wheel for joint rotation therewith about the countershaft axis and having external teeth that are in permanent meshing relationship at the aforementioned transmission ratio of 1:2 with the external teeth of the carrier shaft gear wheel. An advantage of this approach is that it reduces the complexity of the transmission means to a minimum while assuring its reliability and constant maintenance of the predetermined transmission ratio.

Advantageously, stator housing includes an end module that supports the countershaft and accommodates at least the pinion of the one ring and the first countershaft gear wheel. This results, on the one hand, in a stable support for the countershaft and hence the components supported thereon and, on the other hand, in protection of the components accommodated in this end module from the environment of the rotary machine and vice versa.

The carrier shaft has one end portion close to and another end portion remote from the pinion, and there is provided, according to the present invention, a power transmission gear wheel mounted on the other end portion of the carrier shaft for joint rotation therewith. This makes it possible to supply power to the machine when used, for instance, as a compressor, and derive power from the machine when utilized as an expansion motor, in a very simple manner.

A further utilization of this rotary machine can be found in the area of industrial evacuation pumps and rotary pumps or, as the case may be, in modified internal combustion engines or thermal machines of the Stirling type.

BRIEF DESCRIPTION OF THE SEVERAL VIEWS OF THE DRAWING

The present invention will be explained in more detail below with reference to the accompanying drawing in which.

DETAILED DESCRIPTION OF THE INVENTION

Figure 1:
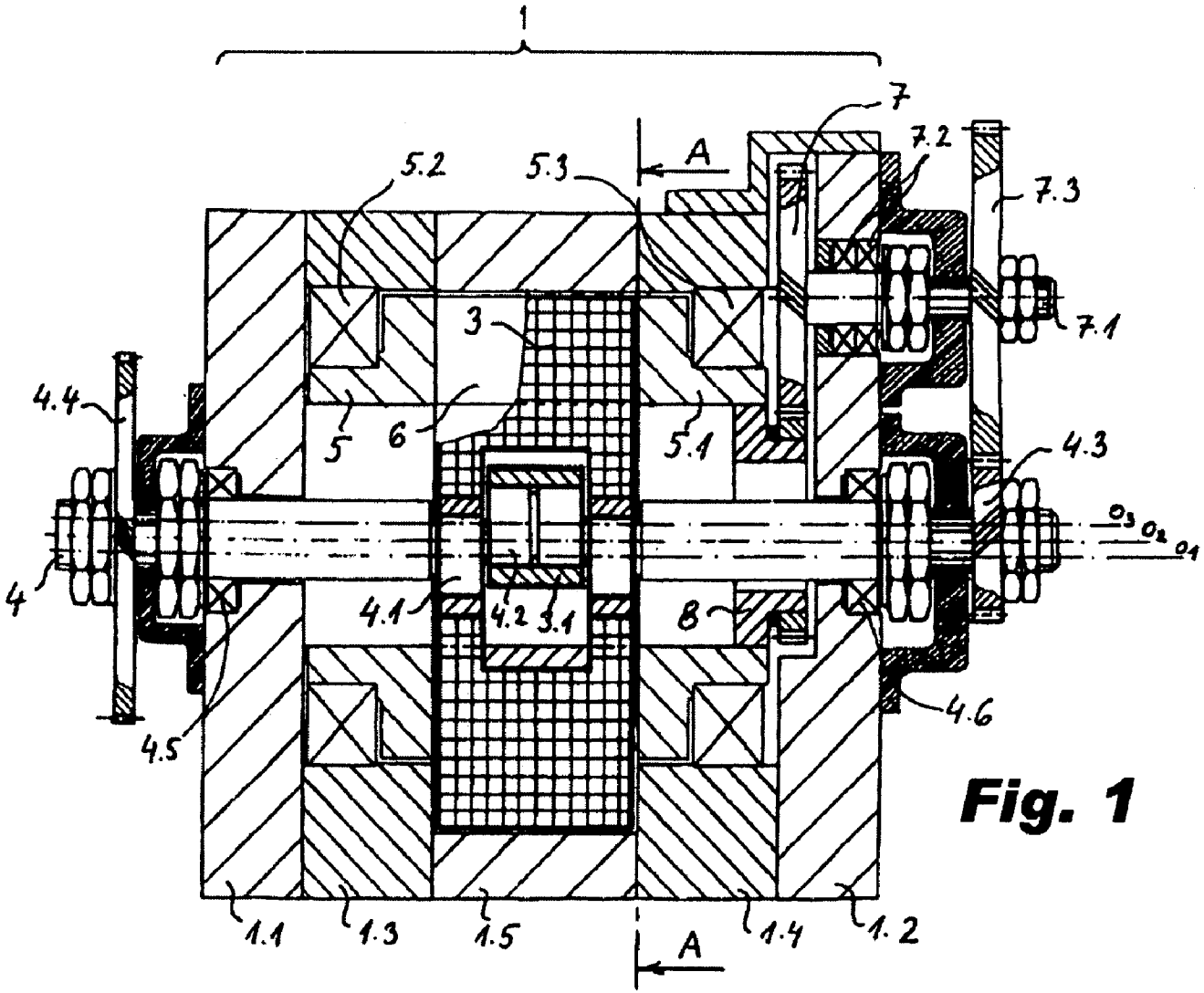
FIG. 1 is an axial sectional view of the rotary machine of the present invention in its assembled condition, taken on line B-B of FIG. 2.

Referring now to the drawing in detail, and first to FIG. 1. thereof, it may be seen that it depicts an example of the implementation of the machine according to the invention that is arranged for two twin blades. The machine includes a stator housing 1, which is constituted by individual plate-shaped modules that are connected to one another. A pair of plate-shaped end modules 1.1, 1.2 axially terminates the stator housing 1. A carrier shaft 4 centered on an axis o2 is supported in the housing 1 by means of a pair of carrier shaft bearings 4.5, 4.6. On the carrier shaft 4, there is formed a central first pair of eccentric members 4.2 centered on an axis o3 for a second twin blade 3.1 supported by means of a pair 3.4 of connecting-rod eyes of the second twin blade 3.1, and a second, axially spaced pair 4.1 of eccentric members flanking the first pair of eccentric members 4.2 and centered on an axis o1 for a first twin blade 3 supported by means of a pair 3.3 of connecting-rod eyes of the first twin blade 3. A pair of annular modules 1.3, 1.4, as well as a central working module 1.5 are situated between the pair of the end modules 1.1, 1.2. A pair of entraining rings 5, 5.1 is supported, on a pair of annular bearings 5.2, 5.3, in the pair of annular modules 1.3, 1.4, The entraining rings 5, 5.1 are mutually interconnected by entraining bars 6, which are on both sides in sliding contact with each of the end surfaces of the pair of twin blades 3, 3.1.

A pinion 8 is formed on the entraining ring 5.1. The pinion 8 is equipped with external teeth that are in a permanent meshing relationship with external teeth of an inner countershaft gear wheel 7. The gear wheel 7 is supported on a countershaft 7.1 that is supported in the plate-shaped end module 1.2 by means of a pair of countershaft bearings 7.2. The countershaft 7.1 is provided at its outer end with an outer countershaft gear wheel 7.3 with external teeth that are in permanent meshing relationship, in a transmission ratio of 1:2, with external teeth of an outer gear wheel 4.3 of the carrier shaft 4. The carrier shaft 4 is provided at the opposite end that is remote from the pinion 8 with an external gear wheel 4.4 serving, depending on the use of the rotary machine, as a power input or a power output member. For simplification, reference will be had throughout this application merely to "power" or "torque", regardless of whether they constitute the input or the output of the machine.

Figure 2:
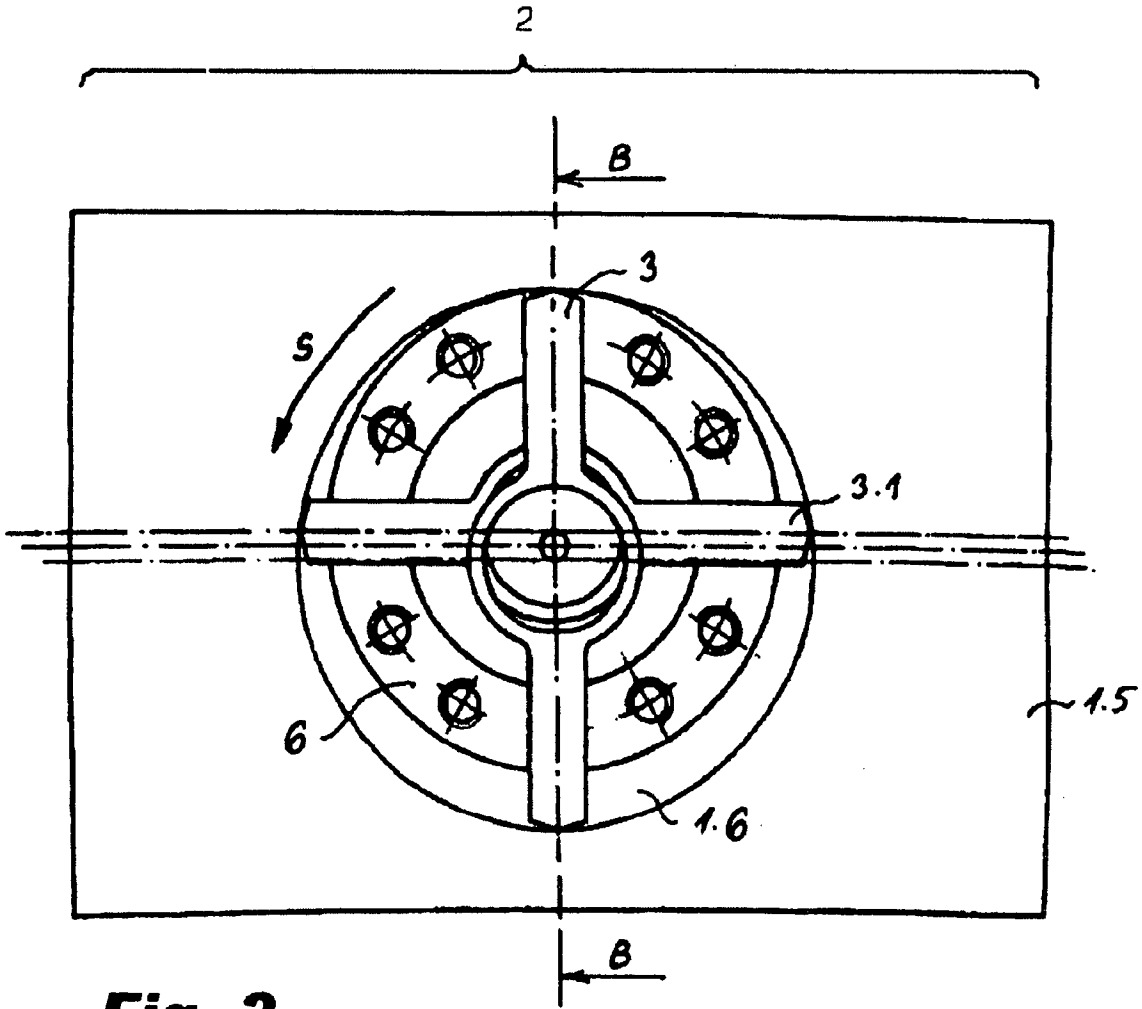
FIG. 2 is a cross-sectional view, taken on line A-A of FIG. 1, of the construction of the rotary machine with two twin blades in an immediate basic configuration.

FIG. 2 shows the rotary part 2 and the instantaneous basic or initial position of the pair of twin blades 3, 3.1 in the working space 1.6 of the central working module 1.5, and also indicates a direction s of rotation of the rotary part 2.

Figures 3A, 3B, 3C:
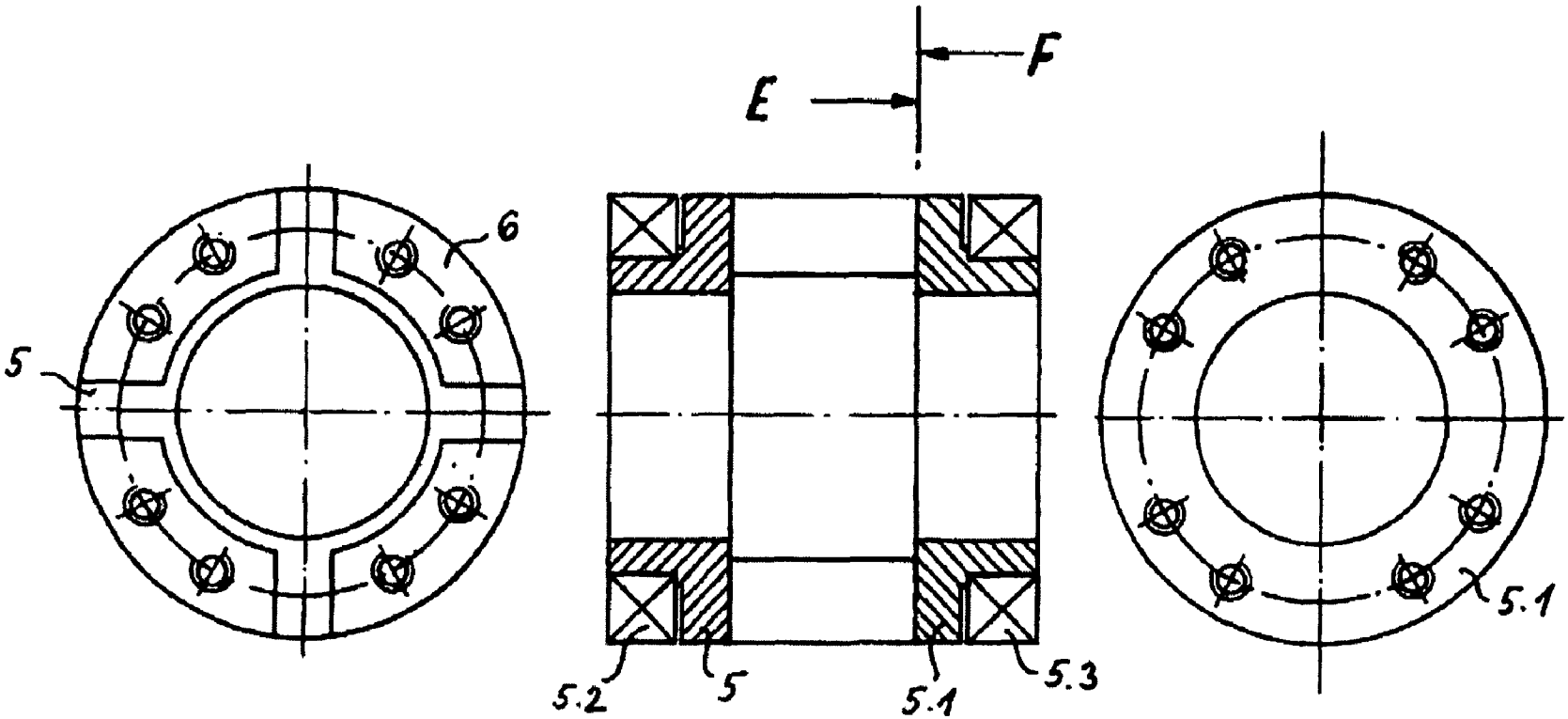
FIGS. 3*a* to 3*c* are an axial sectional view, flanked by respective cross-sectional views taken on line F-F and on line E-E, of the implementation of two rings of the rotary part of the machine with entraining bars.

In FIGS. 3*a* to 3*c*, there is visible, in FIG. 3*a*, the arrangement of entraining bars 6 on an entrainment ring 5, and in FIG. 3*c*, the construction of an entraining ring 5.1 on the side facing toward the working space 1.6. Between FIGS. 3*a* and 3*a*, there is situated the axial sectional view of FIG. 3*b* that shows the construction of the entraining rings 5, 5.1 and their support on the entraining ring bearings 5.2 and 5.3.

Figure 4:
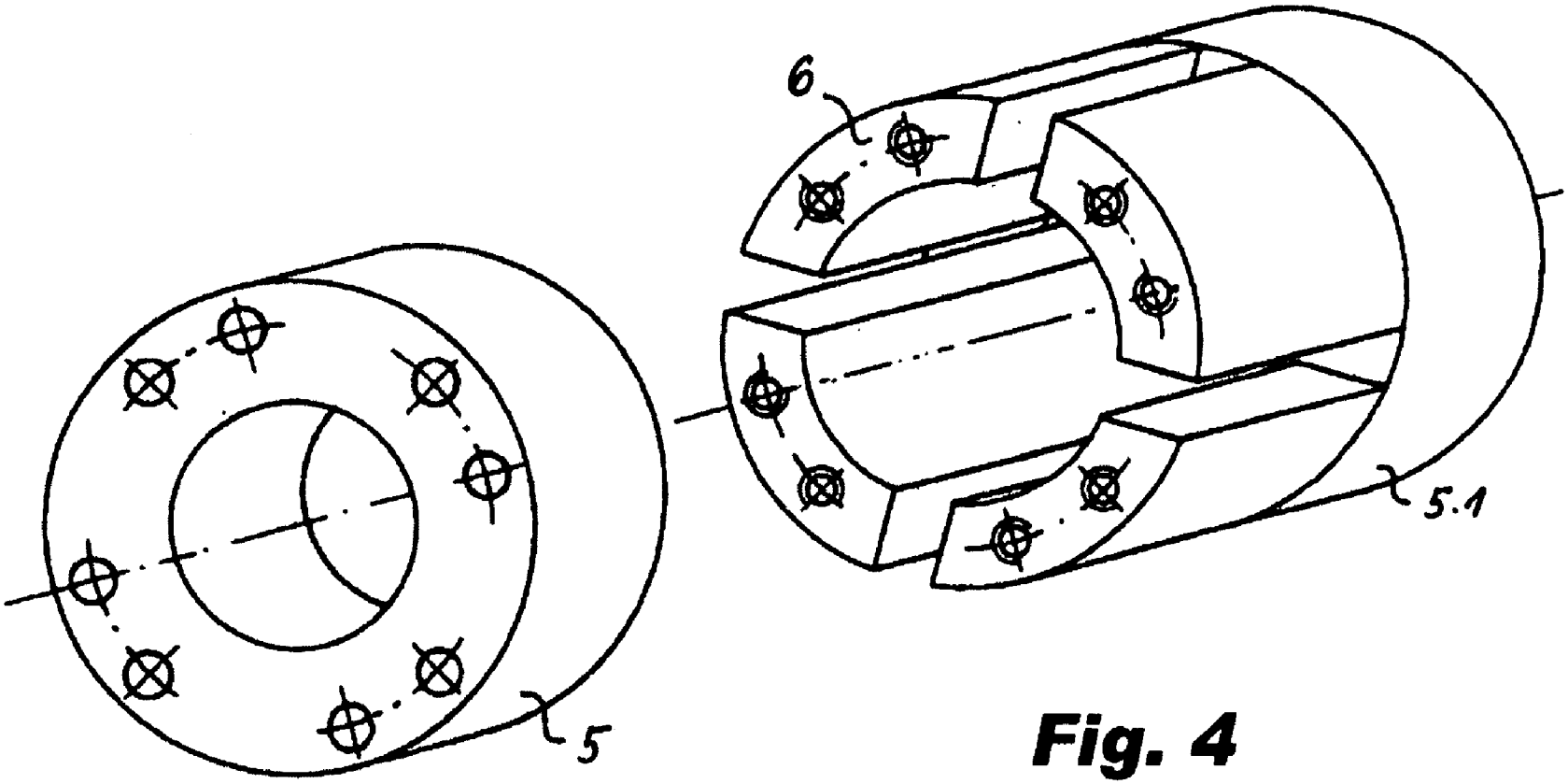
FIG. 4 is a partially exploded axonometric view of the rotary part of the machine with the entraining rings and entraining bars as shown in FIGS. 3*a* to 3*c;*

FIG. 4 depicts the arrangement of the entraining rings 5, 5.1 and the construction of the entraining bars 6 in an axonometric projection, between which there are visible respective guiding slots for the twin blades 3 and 3.1.

Figure 5A:
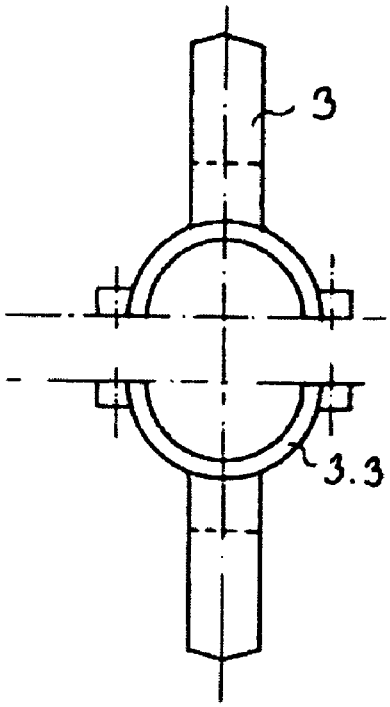
FIGS. 5*a* and 5*b* and FIGS. 6*a* and 6*b* are respective end and side elevational views of an example of the implementation of the twin blades and their connecting-rod eyes for a rotary machine with two twin blades.
Figure 5B:
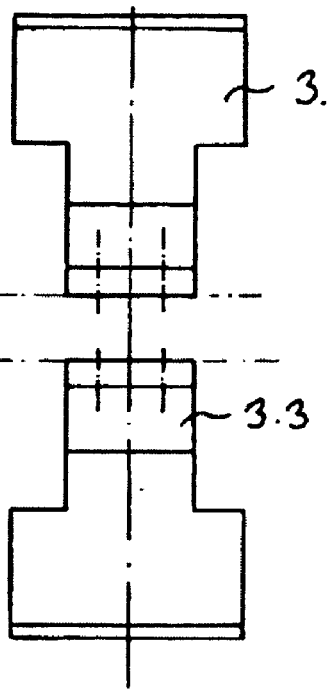
Figure 6A:
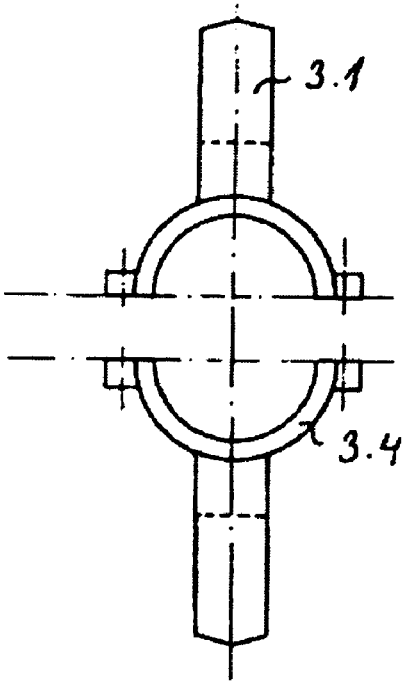
Figure 6B:
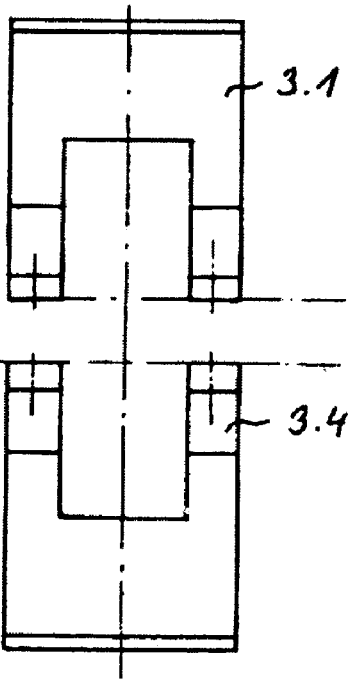

FIGS. 5*a* and 5*b*, and FIGS. 6*a* and 6*b* show in detail a currently preferred implementation of the twin blades 3 and 3.1, wherein the first twin blade 3 with a supporting first blade connecting-rod eye 3.3 is visible in FIGS. 5*a* and 5*b* and the detailed construction of the second twin blade 3.1 with a supporting second blade connecting-rod eye 3.4 is visible in FIGS. 6*a* and 6*b*.

Figure 7:
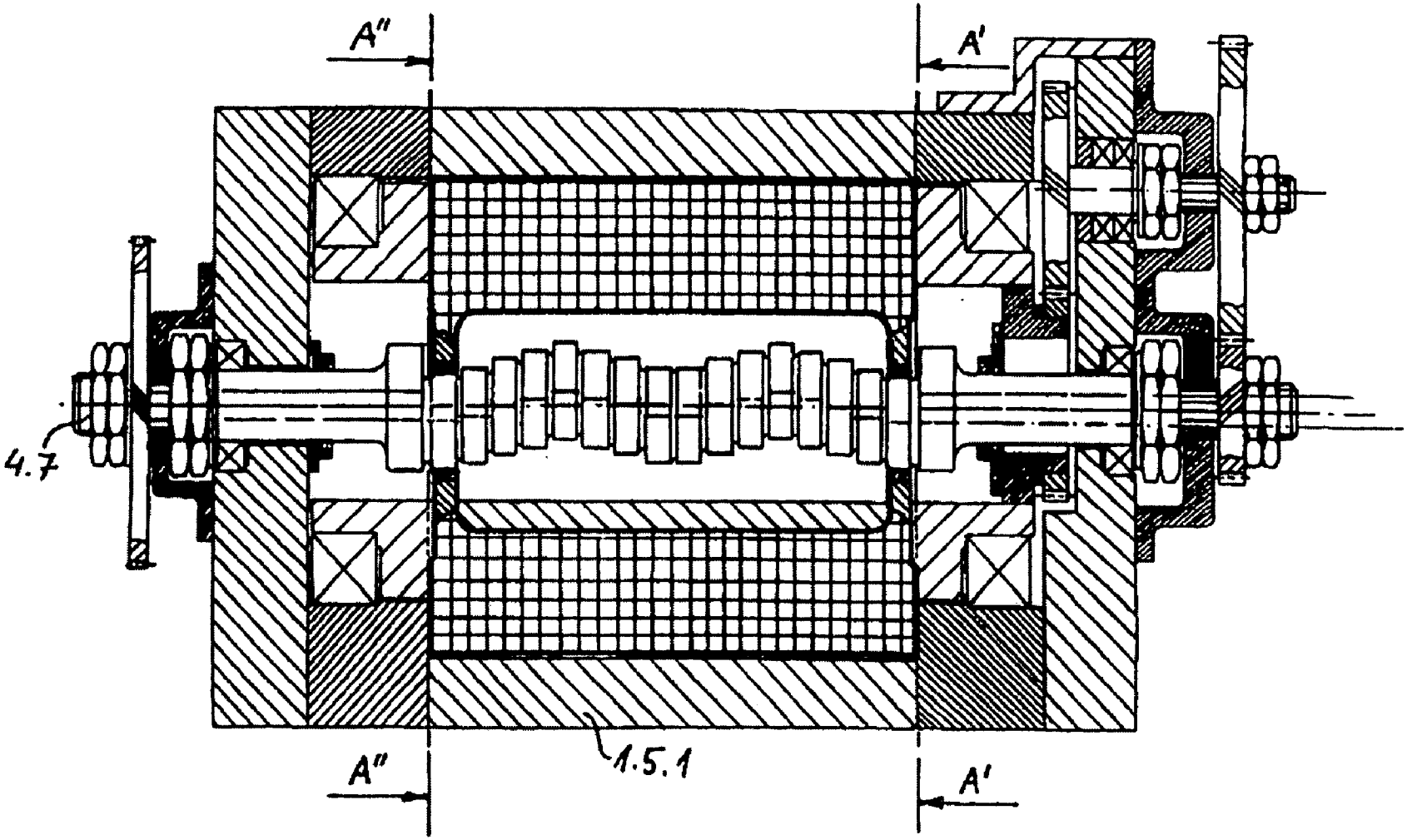
FIG. 7, is a view similar to FIG. 1 but depicting, in a longitudinal sectional view taken on line B'-B' of FIG. 8, an alternative construction of the rotary machine adapted for the mounting of eight twin blades.

In FIG. 7, there is depicted, in a longitudinal section, an example of the embodiment of the rotary machine of the present invention with a carrier shaft 4.7 equipped for the support of eight twin blades in a central working module 1.5.1.

Figure 8:
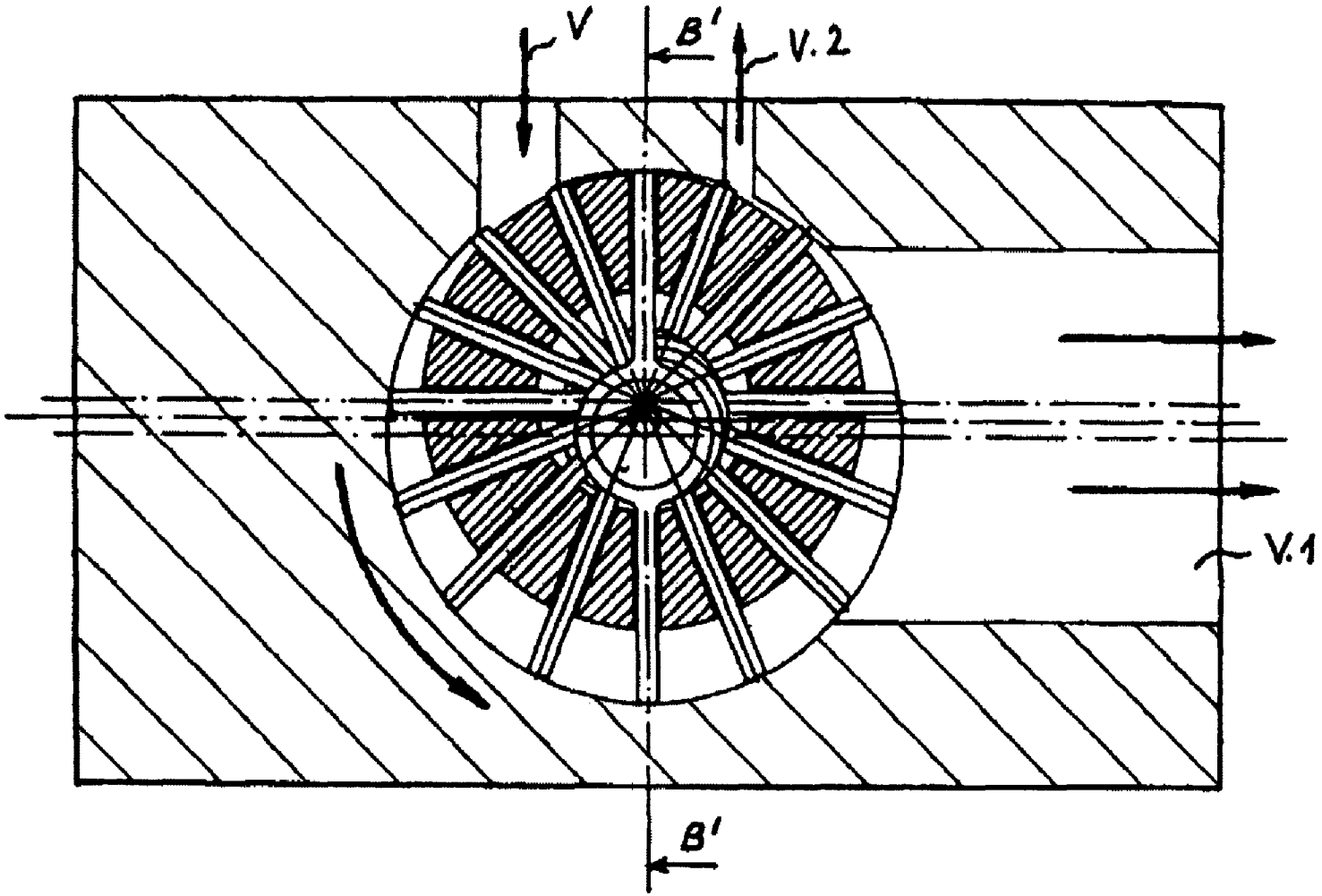
FIG. 8 is a view corresponding to FIG. 2 but taken on line A'-A' of FIG. 7, of an applied construction of the rotary machine with the configuration of channels for the function of the rotary machine as an expansion drive machine with the utilization of the rotary machine with eight twin blades.
Figure 9:
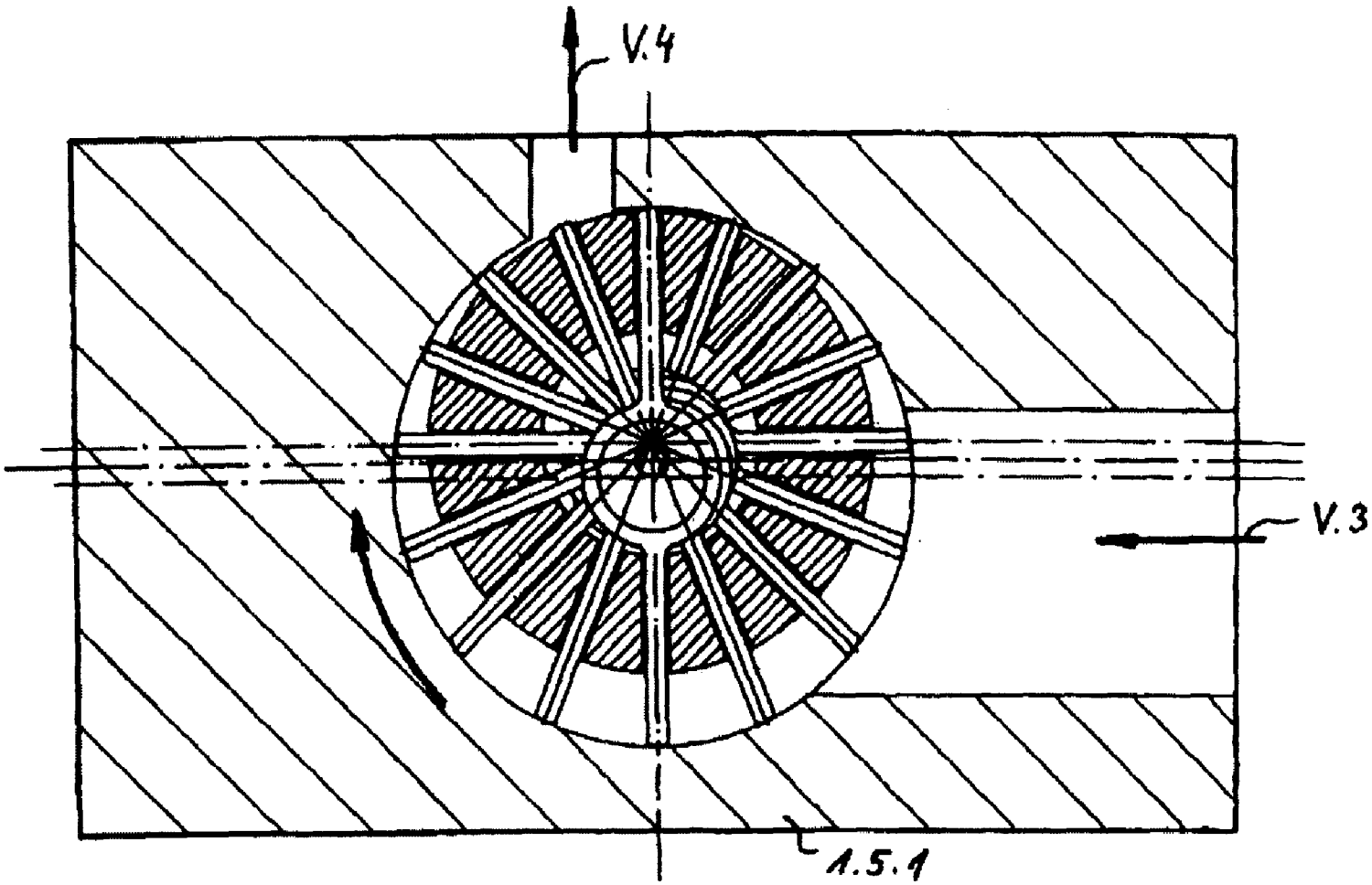
FIG. 9 is a view similar to that of FIG. 8 but taken on line A"-A" of FIG. 7, of the implementation of the rotary machine with eight twin blades and with the configuration of the channels for the function of the rotary machine as a compressor.

FIG. 8 and FIG. 9 represent applications of the rotary machine according to the invention with eight twin blades, which are determined by the desired technical solutions, where, in FIG. 8, an arrangement is depicted for the use of the machine as an expansion drive unit with an inlet channel V, the main output channel V.1 and an auxiliary output channel V.2, and in FIG. 9, here is depicted the arrangement for the utilization of the machine in the function of a compressor, with a compressor input channel V.3 and a compressor output channel V.4.

Figure 10:
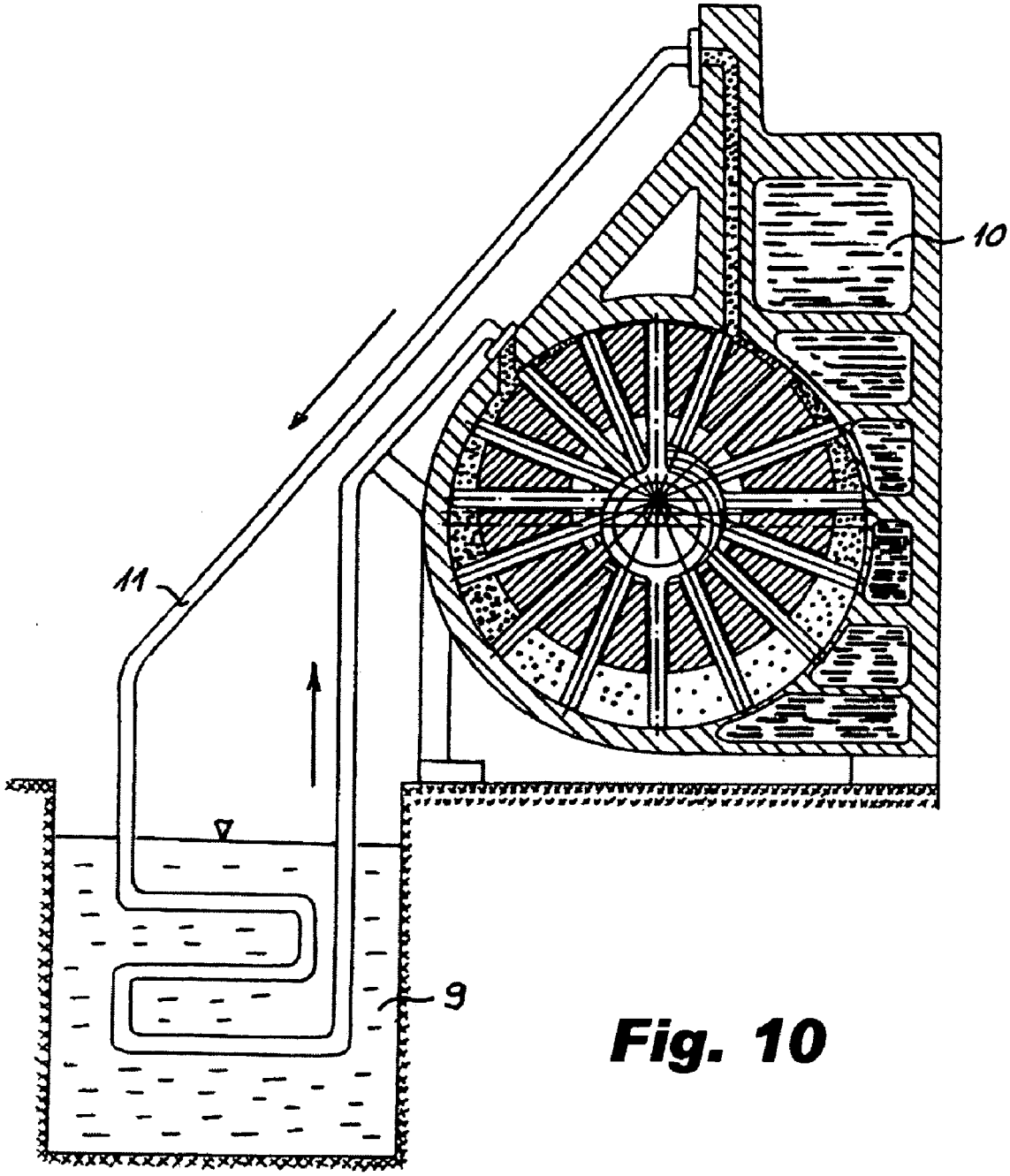
FIG. 10 is a partially sectioned view through the working part of the machine akin to that of FIG. 9, for the application with an expansion drive unit for the utilization of low-potential heat from a geothermal system.

In FIG. 10, there is depicted a rotary machine with eight twin blades, placed as an expansion drive unit utilizing the low-potential thermal energy of a hot spring 9, wherein there is visible a closed circulating circuit 11 of the working medium and a cooler 10 of the geothermal working medium.

Figure 11:
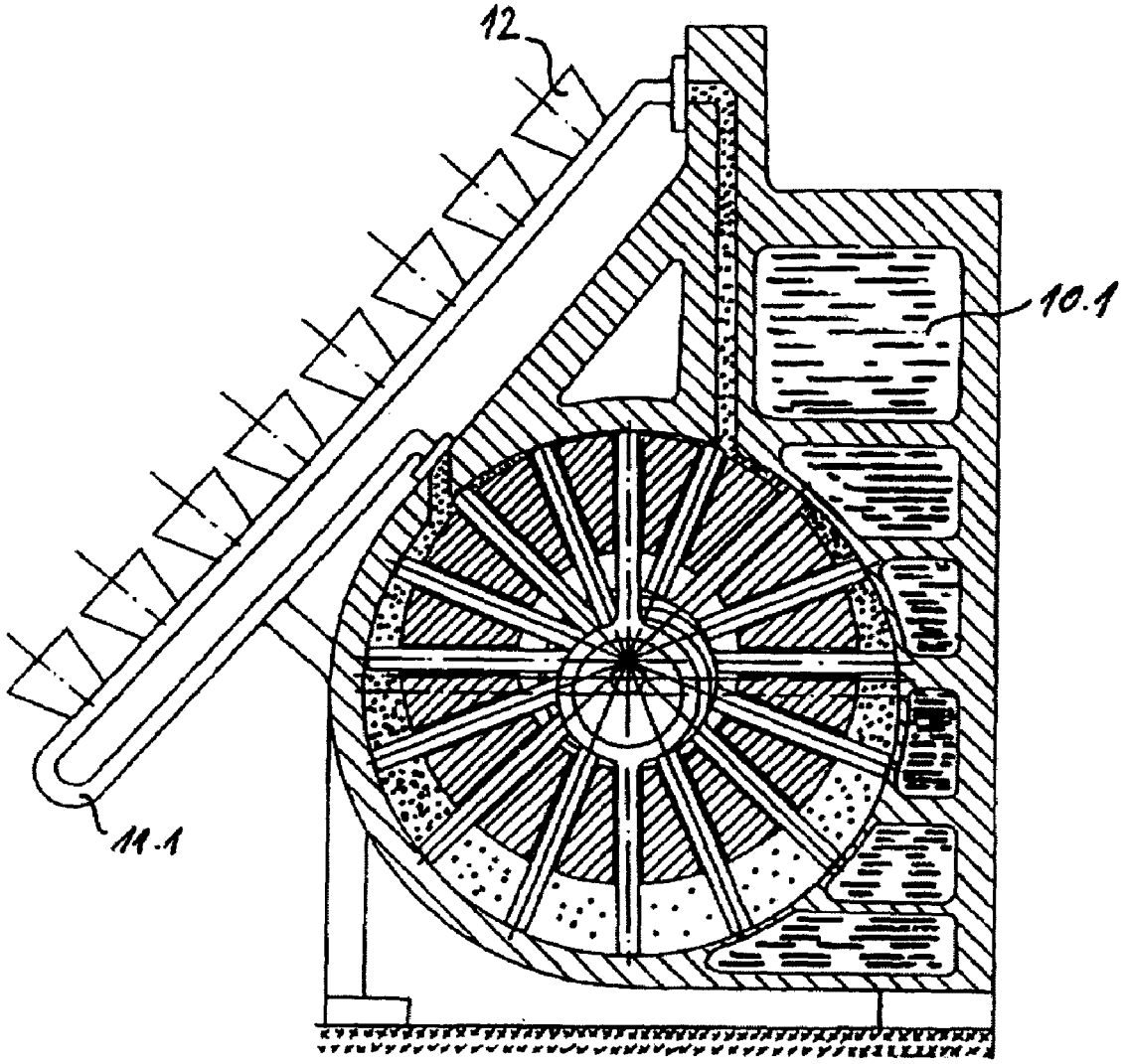
FIG. 11 is a view corresponding to that of FIG. 10 but for the application of the machine for the utilization of low-potential heat from solar energy.

FIG. 11 illustrates a rotary machine with eight twin blades, placed as an expansion drive unit utilizing solar energy obtained by means of an array of focusing devices 12 for the solar energy in a closed circuit 11.1 of the working medium with a cooler 10.1 of the solar energy working medium.

Figure 12:
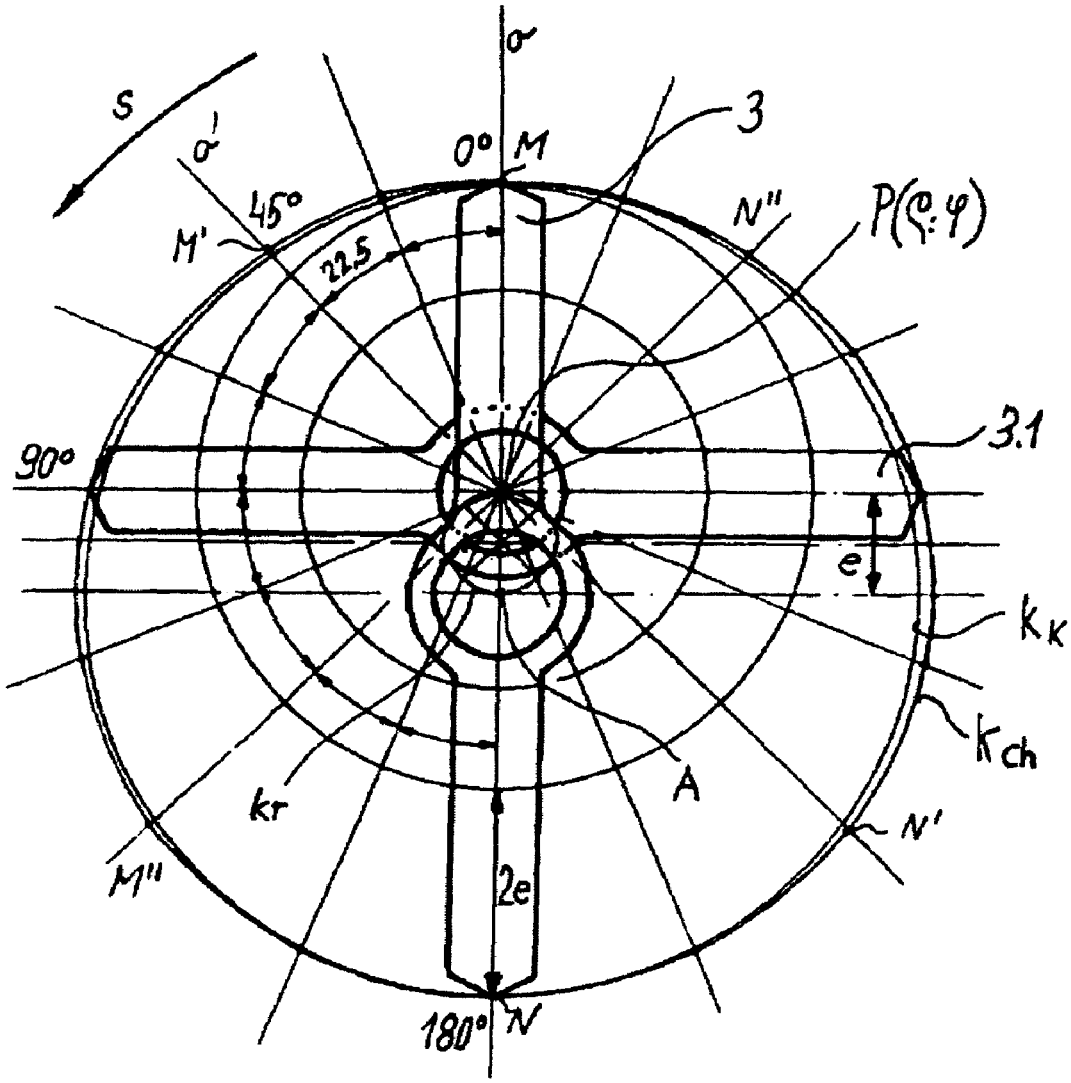
FIG. 12 is a highly diagrammatic view of the instantaneous configuration and position of the twin blades of the implementation FIGS. 1 to 6*b* in the bore in the working central module of the stator housing, taken basically on line A-A of FIG. 2.

FIG. 12 represents the instantaneous configuration and initial position of a pair of twin blades 3, 3.1, wherein the first twin blade 3 is situated in its initial position M, N, where respective points M and N are the points of intersection of an axis o of the first twin blade 3 with a conchoid curve $k_{ch}$ and with a curve $k_k$ of a comparison circle. In all other positions, for instance even in the position angularly displaced by 45° in the direction s of rotation into a position M', N', the intersection point of the angularly displaced axis o' of the first twin blade 3 remains on the conchoid curve $k_{ch}$, but it does not follow the curve $k_k$ of the comparison circle any more. Simultaneously, the second twin blade 3.1 gets in the same manner into the position M", N".

Figure 13:
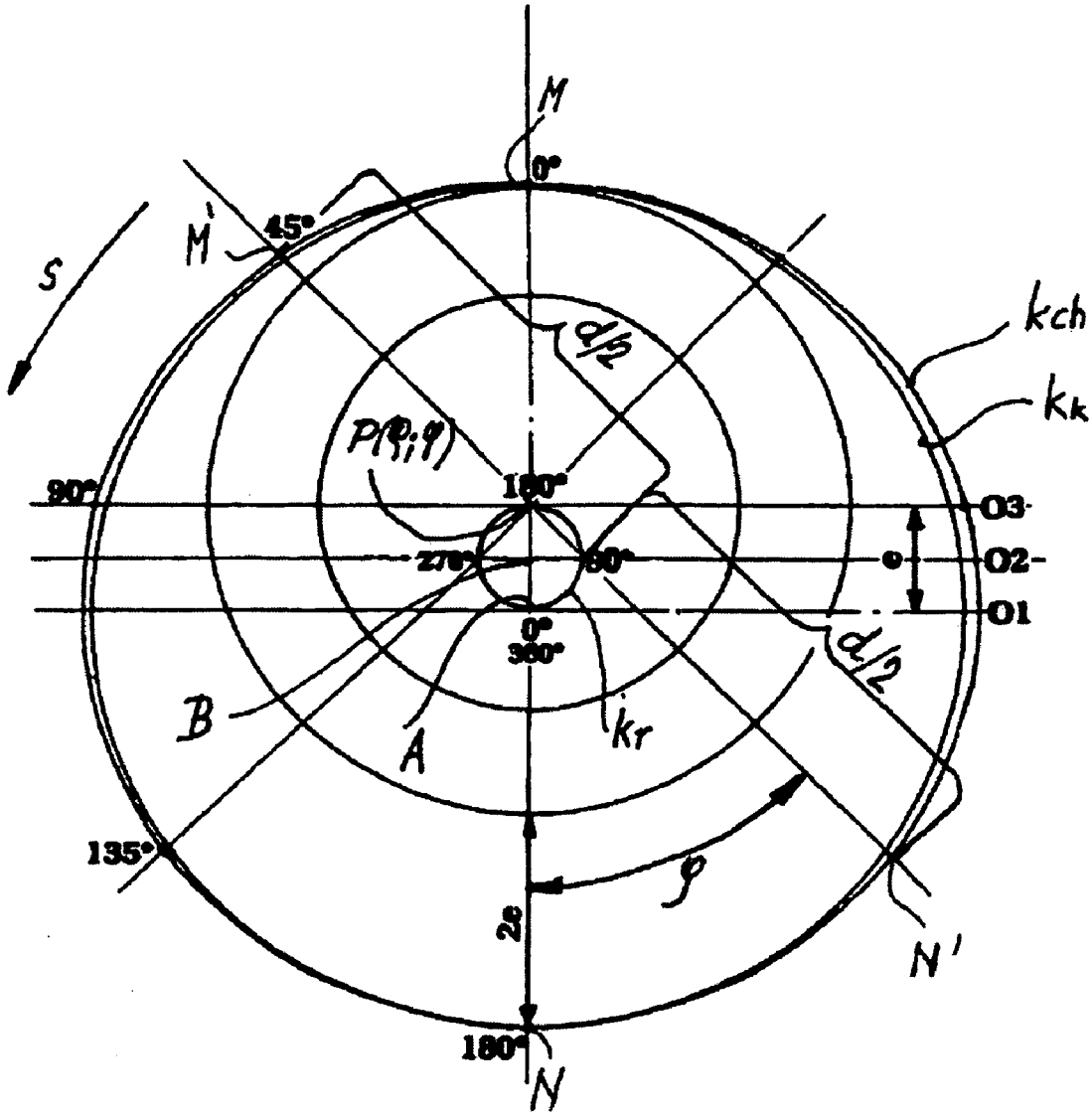
FIG. 13 is a graphic representation showing the derivation of the conchoidal curve of the movement of the end points of the axis of the twin blade during the rotation, with the indicated comparison circle.

FIG. 13 depicts the geometric derivation of the shape of the working space 1.5.2 formed in the central working module 1.5 of the stator housing 1, wherein the outline curve $k_{ch}$ of the conchoid reveals its conchoidal shape and where there is evident the curve $k_k$ of the comparison circle with its center at a point A situated on the axis o1 and having a diameter d/2. This shows the difference between its actual shape corresponding to the curve $k_{ch}$ of the conchoid and the comparison curve $k_k$ with a diameter d=MN that simultaneously corresponds to the length of the twin blade as taken on its axis o. Simultaneously, there is indicated here a controlling circle $k_k$ of the curve $k_{ch}$ of the conchoid with a center located at the point B situated on the axis o2 of the carrier shaft 4. The initial position of the respective twin blade represents, on the one hand, the length d that simultaneously corresponds to the dimension MN on its axis o, and at the same time the limiting diameter of the curve $k_{ch}$ of the conchoid of the same diameter as the length d, wherein d=length of the twin blade=diameter of the curve $k_k$ of the comparison circle=diameter of the curve $k_{ch}$ of the conchoid in the initial position of the twin blade with the end points M, N. The controlling circle $k_r$ of the curve $k_{ch}$ of the conchoid has a diameter e, wherein 2*e* represents the length of the maximum protrusion of the twin blade out of the rotor part. The point P represents the intersection of all of the axes of the twin blades in all positions and lies on the axis o3.

Figure 14:
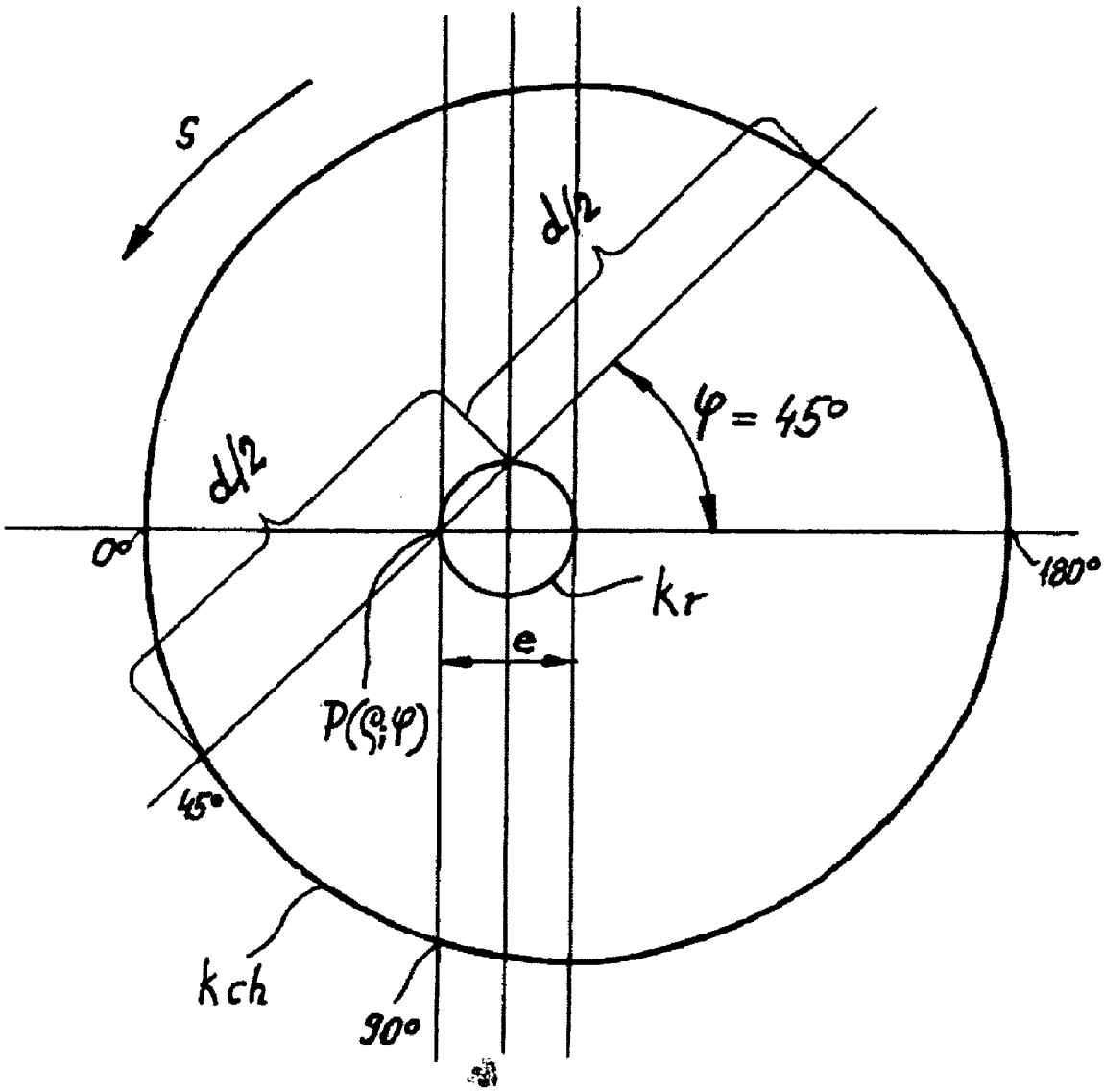
FIG. 14 is another graphic representation individually illustrating the conchoidal curve together with mathematical quantities introduced into the parametric equation.

In FIG. 14, there is individually illustrated the mathematical derivation of the conchoidal curve $k_{ch}$ the parametric equation of which in polar coordinates P (ρ, ϕ) is $$\rho = e.\cos\phi + /- \tfrac{1}{2}d$$

wherein ρ denotes the distance on the curve $k_{ch}$ of the conchoid from the pole P, ϕ denotes the instantaneous turning angle of the axis o of the twin blade, wherein ϕ=45° for this illustrated instantaneous example, and P denotes the point of origin of the set of polar coordinates (ρ, ϕ) of the axis o of the twin blade that moves on the curve $k_{ch}$ of the conchoid. The axes of all of the twin blades in all possible turning angles always pass through the point P which may thus be referred to as the pole.

The function of the machine according to the invention can be explained with the aid of FIG. 1. FIG. 2 and FIG. 12, wherein during the turning of the symmetrical twin blade 3 out of the initial position M, N in the direction of rotation s, there occurs a deviation of the center of the twin blade 3 along the controlling circle $k_r$ of the conchoid in dependence on the corresponding turning of the eccentric member 4.1 formed on the carrier shaft 4. As a result of this, there occurs the projection of the twin blade 3 out of the rotor part 2 and back in such a manner that the end points M', N' of the axis o of the twin blade 3 always precisely track the curve $k_{ch}$ of a conchoid that is identical with the conchoidal curve $k_{ch}$ formed in the central working module 1.5 of the stator housing 1. The pair of twin blades 3, 3.1 then subdivides the work space 1.5.2 into four compartments that, owing to the eccentric support of the rotor part 2, continuously change their volume during the rotation of the rotor part 2, wherein the volume of each of such compartments increases at first in the sense of expansion and, after the respective end portion of the twin blade 3 has reached the lower turning point corresponding to the maximum volume of the compartment, the volume of the respective compartment decreases in the sense of compression. In the course of repeated turning of the rotor part 2, there is obtained uninterrupted retrieval of expansion work out of the energy medium in the event of the utilization as an expansion drive unit and/or consumption of input work for obtaining a compressed medium in the event of the utilization in the function of a compressor.

FIGS. 15*a* to 15*d*, from which most of the alphanumeric reference characters have been omitted in order not to unnecessarily clutter the drawing, depict the positions of one of the twin blades (such as the twin blade 3 referred to previously), that such blade assumes relative to the stator housing and to the rotor part as the latter turns in the direction indicated by the arrow s. In this diagrammatic representation, the blade in question is represented by a thick black line, while the position of the center of the respective twin blade is indicated by a white area on that thick black line.

Figure 15A:
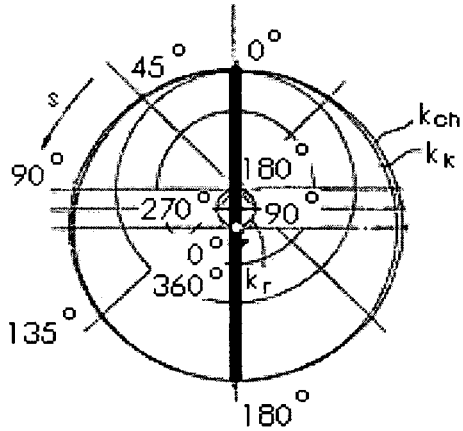
FIGS. 15*a* to 15*d* are views corresponding to FIG. 13 but at a reduced scale and showing the positions of one of the twin blades relative to the inner surface of the stator housing and to the rotor part in four different consecutive phases of rotation of the rotor part.
Figure 15B:
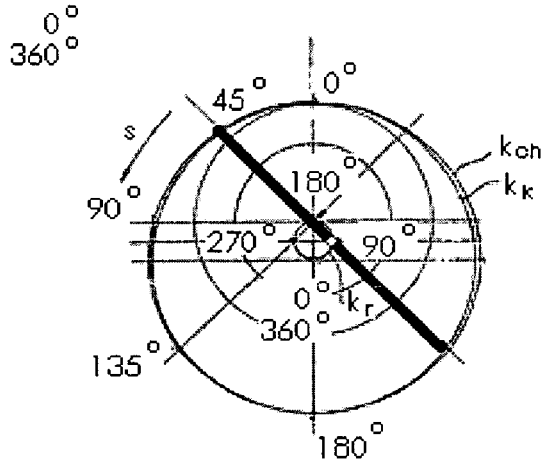
Figure 15D:
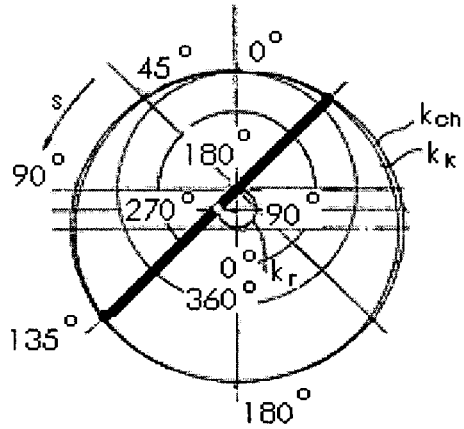
Figure 15C:
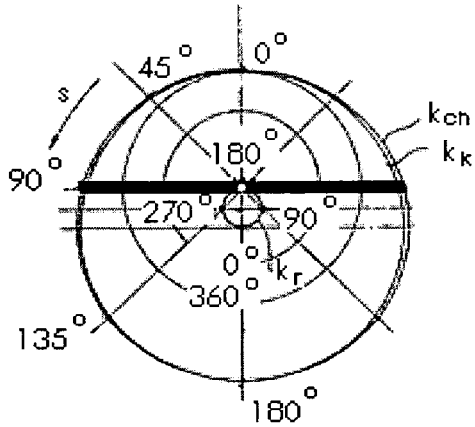

In FIG. 15*a*, the blade is in its initial (vertical) position and its center (which is always situated on the controlling circle $k_r$) is at the lowest point of that circle. The next phase of the movement of the rotor part and of the twin blade is shown in FIG. 15*b*. In this position, the rotor part had moved in the direction of rotation s by 45°, but the center of the twin blade has moved, due to the double angular velocity of the carrier shaft with respect to the rotor part, into a position on the right of the controlling circle $k_r$ that corresponds to the angular displacement of 90°. In the next phase shown in FIG. 15*c*, it is the twin blade that has been displaced by 90° out of its initial position, but at this time the center of the twin blade has reached the top of the controlling circle $k_r$, that is a position corresponding to 180°. Another 45° increment of movement brings the blade into the position shown in FIG. 15*d* and its center to the right of the controlling circle $k_r$, that is into the position corresponding to 270°. Another 45° displacement would then bring the blade into a position corresponding to that shown in FIG. 15*a*, except that the blade would now be, inasmuch as the rotor part has conducted an angular displacement of only 180° by this time, in an upside down position. In all other respects, however, the process of moving through the four phases—and the positions inbetween them—would be repeated on the further turning of the rotor part, so long as the rotary machine is in operation.

It may be seen from FIGS. 15*a* to 15*d* that the movement of the center of the twin blade on the controlling circle $k_r$ coincides with the withdrawal of one end portion of the twin blade into, and the corresponding projection of the other end portion of the twin blade out of, the rotor part. This is consistent with the movement of the ends of such end portions along the conchoidal curve $k_{ch}$. However, it is to be realized that this kind of movement along the curve $k_{ch}$ is not accidental. Rather, it is caused, or forced, by the action on the twin blade of the respective eccentric member carried on the carrier shaft for joint rotation with it. This means that the in-and-out movement of the twin blade relative to the rotor part, and its consequent movement relative to the stator housing, is determined not by a sliding contact of any part of the twin blade with either some sliding support contained within the rotor part or, worse yet, with the surface bounding the internal chamber of the stator housing, but rather solely by the cooperation of the twin blade with the respective associated eccentric members of the carrier shaft. That, however, is an area where any frictional losses can be kept to a minimum by the use of anti-friction or even friction bearings. At the same time, this solution makes it possible to avoid any contact of the ends of the twin blades with the internal surface of the stator housing, where frictional losses encountered in prior constructions are tremendous and even exacerbated if springs are used in addition to centrifugal forces to press the blade ends against the internal surface of the stator. Thus, the ends of the twin blades need not actually come in contact with the internal surface of the stator housing but can move at a minimum distance therefrom, i.e. in the immediate or close proximity of the internal surface.

Without further analysis, the foregoing will so fully reveal the gist of the present invention that others can, by using merely ordinary skill in the art, readily adapt it to various applications in various fields and environments.

While the present invention has been described and shown as embodied in several implementations and possible applications, it is to be understood that various modifications of the structure, as well as other uses, of the machine may be made without leaving the realm of the invention as defined in the following claims.

The invention claimed is:

1. A rotary machine with orbiting twin blades, especially for expansion drive units and compressors, comprising a stator housing having an inner peripheral surface circumferentially delimiting an enclosed internal chamber extending along a stator axis;

a rotor part received in said stator housing for rotation about a rotor axis parallel to and radially offset from said stator axis and including at least two entraining rings axially spaced from one another, and at least four entraining bars extending substantially parallel to said rotor axis at a radial distance therefrom, interconnecting said entraining rings, and defining respective slots between themselves;

means for mounting said rotor part for rotation in said internal chamber about said rotor axis;

a carrier shaft mounted in said internal chamber for rotation about a carrier shaft axis parallel to said rotor axis and extending over the entire axial length of said stator housing;

at least two pairs of eccentric members provided on said carrier shaft for joint rotation therewith and centered on respective axes that are transversely offset from said carrier shaft axis in different radial directions;

at least two twin blades each supported on one of said pairs of eccentric members for relative turning therebetween and including two blade portions passing through oppositely located associated ones of said slots of said rotor part into close proximity of said inner peripheral surface of said stator housing; and means for transmitting torque between said rotor part and said carrier shaft in a permanent 1:2 transmission ratio causing said carrier shaft with said eccentric members to turn in the same direction as but at twice the speed of said rotor part when the rotary machine is in operation with said eccentric members forcing said twin blades to conduct movements relative to said rotor part that cause such blades to follow said inner peripheral surface of said stator housing at said close proximity therefrom.

2. The rotaiy machine as defined in claim 1, wherein said stator housing includes an assembly of plate-shaped modules individually connected to one another, at least some adjacent ones of which have internal bores that together constitute said internal chamber.

3. The rotary machine as defined in claim 1, wherein said transmission means includes a pinion with external teeth on one of said rings, a carrier shaft gear wheel mounted on said carrier shaft for joint rotation therewith, a countershaft supported on said stator housing and centered on a countershaft axis, a first countershaft gear wheel supported on said countershaft and having external teeth that are in pennanent meshing relationship with said external teeth of said pinion, and a second countershaft gear wheel supported on said countershaft, connected with said first countershaft gear wheel for joint rotation therewith about said countershaft axis and having external teeth that are in permanent meshing relationship at said transmission ratio of 1:2 with said external teeth of said carrier shaft gear wheel.

4. The rotary machine as defined in claim 3, wherein said stator housing includes an end module that supports said countershaft and accommodates at least said pinion of said one ring and said first countershaft gear wheel.

5. The rotary machine as defined in claim 3, wherein said carrier shaft has one end portion close to and another end portion remote from said pinion; and further comprising a power transmission gear wheel mounted on said other end portion of said carrier shaft for joint rotation therewith.

* * * * *